United States Patent [19]

King et al.

[11] 4,049,358

[45] Sept. 20, 1977

[54] VISIBLE MARKERS FOR ROAD SURFACES

[76] Inventors: Mendel King, 46 Primley Park Ave.; Raymond Brannan, 42 Ramshead Drive, both of Leeds, England

[21] Appl. No.: 660,225

[22] Filed: Feb. 23, 1976

[30] Foreign Application Priority Data

Sept. 4, 1975 United Kingdom ..... 36535/75

[51] Int. Cl.[2] ..... E01F 9/00

[52] U.S. Cl. ..... 404/11; 40/125 N; 350/102

[58] Field of Search ..... 404/11, 10, 9, 15, 16; 40/125 N; 350/102

[56] References Cited

U.S. PATENT DOCUMENTS

| | | | |
|---|---|---|---|
| 2,157,059 | 5/1939 | Rosener | 404/11 |
| 2,941,447 | 6/1960 | Abbott | 404/11 X |
| 3,292,506 | 12/1966 | Kone | 404/11 |
| 3,377,930 | 4/1968 | Kone | 404/11 |
| 3,703,855 | 11/1972 | Converso | 404/11 |
| 3,717,076 | 2/1973 | Shields | 404/11 |
| 3,920,348 | 11/1975 | Paulos | 404/11 X |

FOREIGN PATENT DOCUMENTS

| | | | |
|---|---|---|---|
| 965,583 | 7/1964 | United Kingdom | 404/11 |
| 614,657 | 12/1948 | United Kingdom | 404/11 |
| 738,993 | 10/1955 | United Kingdom | 404/11 |

*Primary Examiner*—Nile C. Byers
*Attorney, Agent, or Firm*—Sherman & Shalloway

[57] ABSTRACT

A marker for road surfaces is of the type having a mounting adapted to be fixed in the roadway with an aperture at the upper end of the mounting for holding a visible portion held in upraised position by spring means; in the marker of the invention the visible portion is at least one reflector and/or light source, enclosed in a translucent sealed casing which is shaped to move vertically within the mounting.

Preferably the visible portion is a pair of corner-cube reflectors, the mounting around the aperture contacts the casing so as to wipe its faces clean, and the spring means is a solid rubber ball.

9 Claims, 8 Drawing Figures

VISIBLE MARKERS FOR ROAD SURFACES

This invention relates to reflective road markers for use in roadways.

It is well known to fix into road surfaces markers having reflective portions which are resiliently maintained normally in a position in which they reflect light from the lamps of a vehicle but can be depressed below the road surface by the passage of a vehicle wheel. One well known type of reflector used to make the lanes of a roadway is known as a "cats' eyes" reflector and is of a complex construction of metal, glass and rubber; it is expensive to make and install and is easily damaged and it deteriorates under the effect of sun and rain. Another type of marker has been proposed in which a domed reflex reflector is held slidably within a tubular housing which terminates at its upper end in a flange which rests upon the road surface; this type of reflector is not efficient in use and is also somewhat complex to make.

It is an object of this invention to provide a road marker having a highly efficient marking portion, and which marker can be cheaply produced and installed and which is robust and long lasting in use.

According to this invention a road marker comprises 1. a reflector readily visible to the road user when the marker is in its normal position;
2. a translucent hermetically sealed casing made of a polycarbonate resin and containing the reflector(s), the surface of the or each reflector being placed vertically against an inner face of the casing, the casing being shaped for vertical movement within a mounting;
3. a tubular mounting adapted to be fixed in the surface of a roadway and having an aperture at its upper end to allow passage of said portion of the casing containing the reflector(s), and
4. a solid ball made of a silicone rubber, held within the mounting and arranged to urge said casing upwardly.

1. The Visible Portion

Corner-cube reflectors are preferred; these are well known highly efficient and widely used as reflectors on vehicles; such a reflector is a sheet which has on one of its surfaces facets which form a pattern having the appearance of numberous cubes. The angles of the facets should be selected so as to best reflect the light when they are set in the roadway. In the normal construction of the marker of the invention, a pair of such reflectors are placed within the translucent housing with their facetted surfaces toward each other and separated by a small gap; this gap is obtained by forming, on the inward faces of one or both reflector, ridges or posts (which are preferably at the edges of the reflector so as not to interfere with the reflection of the light) which abut against the other reflector. The flat (non-facetted) face of each reflector is against the inner face of the casing or is fused integrally therewith. Such paired reflectors are visible to vehicles travelling in both directions along a roadway; a marker with only a single reflector would be of use in a road carrying traffic in only one direction.

It is also possible to have four reflectors arranged in a quadrangle, so as to be visible to traffic from four directions.

To further increase the visibility of the reflectors, a flat portion may be left on the facetted surface of each reflector to permit the passage of some light which diffuses into the other of the pair of reflectors and illuminates it. The reflectors can be colourless or coloured, and can conveniently be made of a moulded acrylic plastics material in conventional manner.

Other forms of reflector, such as a simple mirror-like reflective sheet, can be used.

In addition to a reflector, a light source, such as one powered by a solar cell, can be used.

2. The casing

The casing containing the visible portion is hermetically sealed so as to contain dry air or other gas, at normal or reduced pressure; it is important that the entry of moisture is prevented since this could form droplets on the reflector(s) or light source(s) which would greatly impair their efficiency. Each vertical wall of the casing, through which light passes to the visible portion, must be at least translucent to light and preferably transparent, and should have parallel faces and can be flat, but a better optical effect is obtained if it is slightly curved; in this case the adjacent reflector should also be curved.

The lower part of the casing is a support for the upper part which contains the reflector(s) or light source(s) and is shaped to fit within the mounting part which is fixed in the road, and this lower part travels like a piston within the casing.

The casing must be made of a plastics material having excellent toughness (to withstand the impact of a vehicle wheel travelling at high speed), and which retains for many years its translucency without cracking or discolouring, and can be sealed so as to enclose the reflectors. Certain types of polycarbonate resin can be used for this purpose, such as that marketed under the trade mark "Lexan" by General Electric Co.

3. The Mounting

The road mounting portion consists of a tubular part (which is most easily constructed of circular cross-section), into which the base of the casing fits, the bottom of the tube being closed entirely in watertight manner by a base portion and the tube being closed at the top except for an aperture through which projects the part of the casing containing the visible portion.

The reflector casing is inserted into the mounting before the base of the mounting is assembled, and the base is then securely fixed, e.g. by gluing, welding and/or screwing.

The upper part of the mounting is expanded peripherally into a flange to fit on the roadway. Grooves or ridges can be formed on the outside of the housing to assist its fixing in a hole in the roadway. Preferably, raised shoulders are formed on top of the flange at locations which do not obstruct the light to the visible portion, the shoulders being designed to give some protection to the upstanding casing and to reduce the extent by which the casing is depressed by a vehicle wheel and also to give an audible warning to the driver when the wheel traverses the marker.

The mounting can be made of a tough, slightly resilient, moulded plastics material such as polyethylene; this material is self-lubricating and allows easy travel of the sides of the reflector casing to and fro in the aperture at the top of the mounting. Most preferably the four edges of this aperture are formed into thin flaps which keep in contact with the faces of the casing and wipe them clean.

4. The spring

The spring is fitted in the bottom of the tubular part of the housing and beneath the underside of the casing and is a solid sphere of a synthetic rubber (e.g. a silicone rubber); we have found that this is extremely long-lasting.

The marker and its method of use will be further described by reference to the accompanying drawing, wherein.

Figure 1:
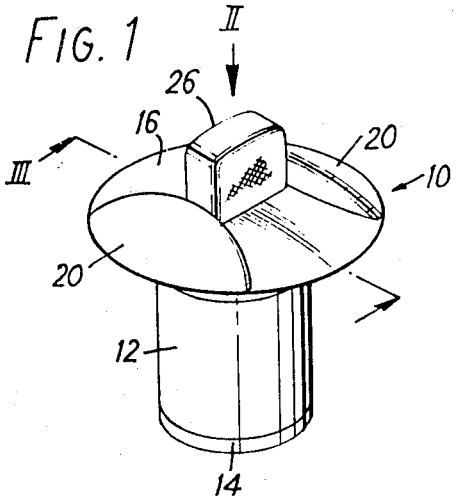
FIG. 1 is a perspective view of a preferred embodiment of the entire marker.
Figure 2:
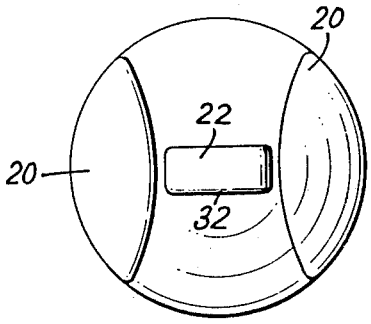
FIG. 2 is a view of the mounting member seen from above (from direction (II) in FIG. 1)
Figure 3:
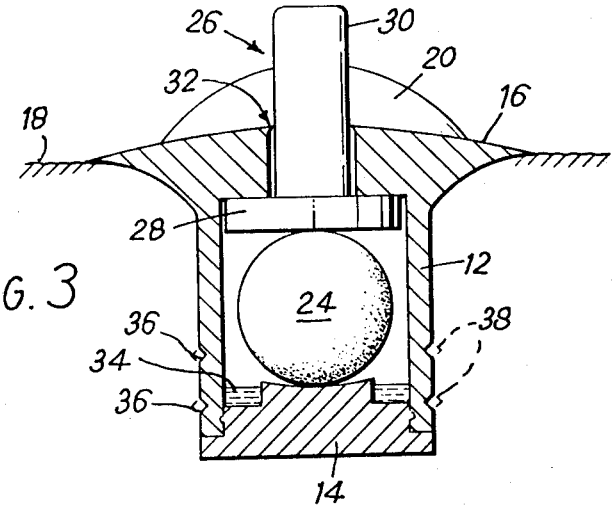
FIG. 3 is a vertical section of the marker on line III—III of FIG. 1, the details of the interior of the reflector casing being omitted, and the marker being in its normal, operative position.

Referring to FIGS. 1, 2 and 3, a mounting member 10 has a cylindrical tube 12 for fixing in the roadway, a base 14 which is glued to the tube 12, a flange 16 which rests on the roadway 18, a pair of shoulders 20 and an aperture 22 for the casing. The mounting member 10 is made of polypropylene which can contain a dye or pigment (which may be luminous) so as to render the marker more visible.

A solid ball 24 (shown separately in FIG. 1) made of silicone rubber fills most of the interior of the tube 12. A casing 26 which houses the visible portion of the marker, namely the reflectors (not shown in FIGS. 2 to 4) has a lower disc-like portion 28 which rests on the base 24 and an upper part 30 shaped like a tombstone.

The lower portion 28 of the casing fits fairly closely inside the tube 12, but a gap must be left sufficient to allow rainwater to be ejected upwardly. Around the four edges of the aperture 22 are thin non-scratch wiping portions 32 (better seen in FIG. 5) which contact the faces of the casing portion 30.

Figure 4:
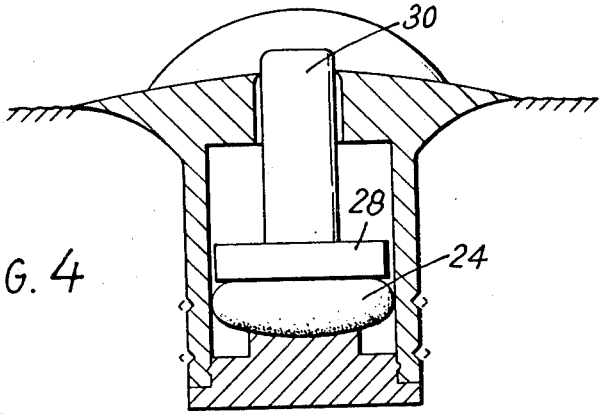
FIG. 4 is a view similar to that of FIG. 3 but with the casing depressed to its full extent by a vehicle wheel (not shown)

When the casing is depressed by a vehicle wheel, the ball 24 is compressed, as shown in FIG. 4, the trapped air present is blown upwardly and then any rain-water which has collected at 34 at the bottom of the tube 12 is ejected upward; both the air and water assist, in conjunction with the wipers 32, to clean the vertical faces of the casing portion 30. After passage of the vehicle the ball resumes its spherical state and pushes the casing upward, as in FIG. 3, and there is again a wiping of the faces of the casing.

Grooves 36 or ridges 38 may if desired be provided horizontally (as shown in FIG. 3) or vertically in the outer part of the mounting tube 12, to assist its retention in the roadway. The lower part of the flange could be flat (instead of curved, as shown).

We now refer to FIGS. 5 to 8.

A pair of corner cube reflector sheets 40 of conventional pattern are held inside the upper part 30 of the casing 26 with their facets toward each other; ridges 42 along the bottom of the reflectors and posts 44 at the top serve to separate them (there must be a small gap between them); the thus separated reflectors are preferably welded together at the separating means. The reflectors are supported upon a plug 46 integral with the base 48 of the casing (other support means could be used, or the reflectors could extend down to the base of the casing although their lower part would then not be visible). After insertion of the reflectors, the base 48 is welded to the rest of the casing at 50, e.g. by ultrasonic heating, in a dry atmosphere.

Figure 5:
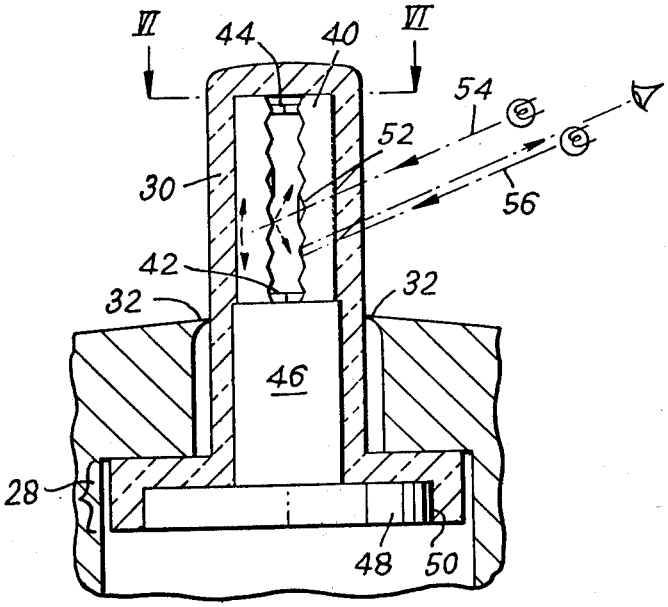
FIG. 5 is an enlarged vertical section of the casing and of its interior containing two reflectors and part of the adjacent mounting member.

Most of the light from a vehicle's lights is reflected back to the driver by the facets at the rear surface of each reflector 40, as shown for the ray 56 in FIG. 5. However, preferably, a small flat area 52 is left amongst the facets on each reflector, as a window through which some light 54 can pass to diffuse up behind the reflector and inside the other reflector, as shown in FIG. 5. The windows are not placed opposite each other, but staggered, as shown in FIGS. 5 and 6.

Figure 8:
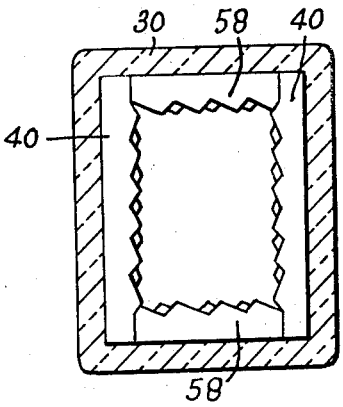
FIG. 8 is a cross-section similar to that of FIG. 6 of a modified casing containing four reflectors.

In FIG. 8 is shown an arrangement with an extra pair of reflectors 58, for a marker visible from all directions. In this case the shoulders 20 might be modified in shape or size.

Figure 6:
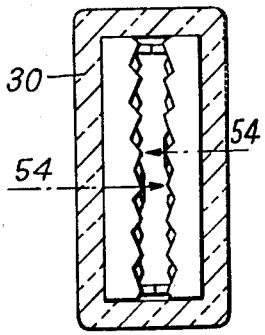
FIG. 6 is a cross-section on line VI — VI of FIG. 5.

The casing portion 30 is shown as flat-sided, but it, and the adjacent face of the reflector, can be slightly bowed (as seen from above, cf. FIG. 6).

The casing is made of a weldable extremely tough and transparent resin such as a polycarbonate, optionally surfacecoated to give maximum clarity.

Figure 7:
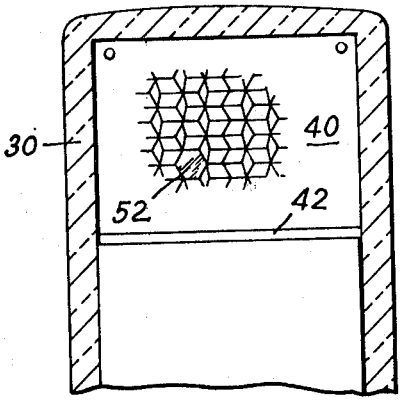
FIG. 7 is a face view of part of the casing of FIG. 5.

The upper part of the casing preferably has its upper corners slightly rounded, as shown in FIGS. 1, 5 and 7, and in this case the reflectors are preferably shaped likewise so that they extend to the top of the casing.

The reflector(s) can be moulded integrally with the casing; this can be convenient when the reflectors are colourless: or a separately made reflector can be welded (e.g. ultrasonically) to the inside of the casing which in this case is best constructed in two halves, consisting of the elements 30, 46, 48 all formed in two vertically divided halves which are then hermetically sealed together.

The marker described and illustrated can be modified by placing between the reflectors 40 a light source or replacing the reflector sheets 40 by other forms of reflector. Such light source could be powered by electricity from a mains supply, a dry battery or a solar cell; the lightsource is preferably not a point source but rather is an illuminated face of a size like that of the reflectors shown. This might comprise a sheet having on its surface both solar cells which during daylight generate electricity which is stored in a battery, and light-emitting areas which are illuminated during darkness. A marker which includes a light source is visible even when light is not directed at it.

A roadway can be marked as follows. A hole is drilled in the surface, a suitable quick-drying adhesive inserted, and the tube 12 of a marker of the invention is pushed into the hole until the flange 12 rests on the surface 18; the marker is aligned to the direction of traffic (i.e. on line III—III in FIG. 1).

Markers having mounting parts and/or visible portions of different colours can be arranged in the road as described.

The marker of the invention is light in weight and a large number can be carried in one laying vehicle and installed by one workman with little interference to traffic flow. The marker is also inexpensive, extremely long lasting and robust in use and its visibility can be superior to that of known devices.

We claim:

1. A light-reflective road marker comprising:

1. an outer tubular member closed at its base and adapted in a roadway, the upper part having a flange extending outwardly to lie on the surface of the roadway,
2. at least one reflector held in a translucent plastic casing mounted for reciprocation in the upper part of the tubular member with its reflective surface against the inside of the casing in a plane of the long axis of the tubular member, and
3. spring means within the tubular member arranged to bias the reflector casing upwardly to allow retraction of the casing into the tubular member under pressure of a vehicle tire, said spring means being a solid spherical ball made of silicone rubber, and said casing is a polycarbonate resin sealing said reflector hermetically therewith so that entry of moisture is prevented.

2. A marker as claimed in claim 1, wherein the edges of the said aperture in the mounting are wiping portions which contact the faces of the casing which contain the reflector.

3. A marker as claimed in claim 2, wherein the mounting is made of a self-lubricating synthetic plastics material.

4. A marker as claimed in claim 3, wherein the mounting is made of polypropylene and the wiping portions are integral with the body of the mounting.

5. A marker as claimed in claim 1, wherein the visible portion is at least one corner-cube reflector.

6. A marker as claimed in claim 5, which comprises a pair of the reflectors placed within the housing with their facetted surfaces toward each other and separated by a gap.

7. A marker as claimed in claim 1, wherein the mounting includes shoulders raised above the aperture for the casing.

8. A marker as claimed in claim 1, wherein at least one of the mounting and reflector is coloured.

9. A marker as claimed in claim 1, in which a window is formed in the facetted surface of the or each reflector.

* * * * *

UNITED STATES PATENT OFFICE

CERTIFICATE OF CORRECTION

Patent No. 4,049,358 Dated September 20, 1977

Inventor(s) KING, ET AL.

It is certified that error appears in the above-identified patent and that said Letters Patent are hereby corrected as shown below:

Claim 1, line 3, after "adapted" insert -- for mounting --

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*